US007642724B2

(12) United States Patent
Muto et al.

(10) Patent No.: US 7,642,724 B2
(45) Date of Patent: Jan. 5, 2010

(54) LIGHT EMITTING ELEMENT DRIVING CIRCUIT

(75) Inventors: Takashi Muto, Atsugi (JP); Masanobu Oomura, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/048,112

(22) Filed: Mar. 13, 2008

(65) Prior Publication Data

US 2008/0238330 A1 Oct. 2, 2008

(30) Foreign Application Priority Data

Mar. 30, 2007 (JP) ..... 2007-092134

(51) Int. Cl.
*H05B 37/00* (2006.01)

(52) U.S. Cl. ..... 315/172; 315/226; 315/291; 315/307

(58) Field of Classification Search ..... 315/172, 315/209 R, 224–226, 291, 294, 307–308, 315/360; 345/46, 56, 63, 77, 84, 204; 363/21.01, 363/21.1, 21.18; 323/282–283
See application file for complete search history.

(56) References Cited

U.S. PATENT DOCUMENTS 7,071,630 B1 * 7/2006 York ..... 315/224
7,245,089 B2 * 7/2007 Yang ..... 315/307
7,550,931 B2 * 6/2009 Lys et al. ..... 315/291
2004/0257353 A1 * 12/2004 Imamura et al. ..... 345/204
2005/0151489 A1 * 7/2005 Lys et al. ..... 315/308

FOREIGN PATENT DOCUMENTS

JP 11-126935 A 5/1999
JP 2005-210596 A 8/2005

* cited by examiner

*Primary Examiner*—David Hung Vu
*Assistant Examiner*—Tung X Le
(74) *Attorney, Agent, or Firm*—Fitzpatrick, Cella, Harper & Scinto

(57) ABSTRACT

A light emitting element driving circuit, which can achieve accurate/high-speed operation even at low voltage supply voltage, comprises: driving current supply, connected to light emitting element in series between first and second power supplies, to supply driving current to the light emitting element according to the voltage of control terminal; current determiner to determine and output the current according to an output light amount of the light emitting element; current/voltage converter to convert the determined current into voltage and output it to the control terminal of the driving current supply if control signal is in a first state, and to electrically shield its output voltage terminal from the control terminal of the driving current supply if the control signal is in a second state; and resetter to connect the control terminal of the driving current supply to the second power supply if the control signal is in the second state.

8 Claims, 8 Drawing Sheets

LIGHT EMITTING ELEMENT DRIVING CIRCUIT

BACKGROUND OF THE INVENTION

1. Field of the Invention

The present invention relates to a light emitting element driving circuit which can stably control, even at a low voltage supply voltage, an amount of output light of a light emitting element to be used in an image formation device such as a laser printer or the like.

2. Description of the Related Art

An image formation device is the device which converts an electrical signal into a light signal, and writes an image by using light based on the converted light signal. Here, in the image formation device, to drive a light emitting element such as a laser diode for converting the electrical signal into the light signal, a light emitting element driving circuit for supplying a current to the light emitting element according to an image signal is used.

FIG. 7 is a block diagram illustrating an example of the constitution of a conventional light emitting element driving circuit. To make an amount of light of a laser diode 101 acting as the light emitting element constant, the light emitting element driving circuit of this type is equipped with an APC (automatic power control), which executes an automatic light-amount adjustment function, to monitor the amount of light of the laser diode 101 by using a photodiode 102 acting as a light detecting element. Here, the photodiode 102 monitors the amount of light of the light emitting element 101, and executes photoelectrical conversion thereof to generate a first current I11.

To acquire a desired light emitting element driving current, a driving current adjustment circuit 103 controls the gate voltage of an NMOS (Negative-channel Metal Oxide Semiconductor) transistor 104 to be used for determining a driving current at a voltage correlated with the first current I11, according to a control voltage V11. A second current I12 correlated with the first driving current I11 flows in the drain of the NMOS transistor 104. A differential switch circuit which is constituted by an NMOS transistor 105 and an NMOS transistor 106 is controlled in response to image signals V12 and V13. Then, the differential switch circuit executes switching between the laser diode 101 and a resistor 107 to flow the second current I12, thereby modulating the driving current of the laser diode 101.

In recent years, the power supply voltage of a commonly used system has reduced from 5V to 3V. Moreover, to simplify the system and reduce costs by downsizing power supply IC's, it is required to set the power supply voltage of the light emitting element driving circuit to 3V which is the same as the power supply voltage of the system.

However, as illustrated in FIG. 8, a power supply voltage Vcc has to supply various kinds of voltages for the light emitting element driving circuit of FIG. 7. More specifically, the power supply voltage Vcc supplies a forward voltage Vld of the laser diode 101, a source-drain voltage Vds1 for driving the NMOS transistor 104, and a source-drain voltage Vds2 for driving the NMOS transistors 105 and 106. Here, it should be noted that the NMOS transistors 105 and 106 together constitute the differential switch circuit.

For example, it is assumed that the power supply voltage Vcc is 3V, and the forward voltage Vld is 2.3V. In the circumstances, the voltage which can be allocated to the source-drain voltages Vds of the two NMOS transistors is 0.7V which is a difference voltage between the power supply voltage Vcc and the forward voltage Vld. Consequently, if an NMOS transistor having a sufficiently large W/L (gate width/gate length) is not used, it is impossible to operate the NMOS transistor in a saturation region. For this reason, if the NMOS transistor having the sufficiently large W/L is not used, the drain current becomes unstable, and thus the APC operation is disturbed and the waveform of the light emitting element driving current is distorted. Therefore, in the circuit configuration illustrated in FIG. 7, it is difficult to acquire the stable amount of light at the power supply voltage 3V or so which is lower than the conventional general voltage 5V, whereby it is necessary to enlarge the W/L to acquire the stable amount of light.

FIGS. 9 and 10 respectively illustrate examples of circuits to solve such a problem as described above. More specifically, as well as the circuit illustrated in FIG. 7, the circuit illustrated in FIG. 9 controls the gate voltage of a PMOS (Positive-channel Metal Oxide Semiconductor) transistor 108 to be used for determining the driving current at the output voltage of the driving current adjustment circuit 103. A second current I2, which is correlated with a first current I1 input from the photodiode 102 to the driving current adjustment circuit 103, flows in the drain of the PMOS transistor 108. A differential switch circuit which is constituted by a PMOS transistor 109 and a PMOS transistor 110 is controlled in response to image signals V14 and V15, thereby executing switching of the second current I2. Thus, when the second current I2 flows in the PMOS transistor 109, the laser diode 101 is driven through a current mirror circuit which is constituted by an NMOS transistor 111 and an NMOS transistor 112. On the other hand, when the second current I2 flows in the PMOS transistor 110, the driving current of the laser diode 101 is modulated by flowing the second current I2 to the ground potential through an NMOS transistor 113.

In the above circuit constitution, the element to be serially connected to the light emitting element between the power supply and the ground potential is only the NMOS transistor 112. Thus, it is possible to supply the source-drain voltage which is sufficient to operate the NMOS transistor 109 in the saturation region even at the power supply voltage 3V or so, whereby it is possible to acquire the stable amount of light.

In the circuit in FIG. 10, an NMOS transistor 116 acting as a voltage resetting single-phase switch is connected between the gate of a current mirror circuit constituted by an NMOS transistor 114 and an NMOS transistor 115 and the ground potential. As well as the circuit illustrated in FIG. 9, the circuit illustrated in FIG. 10 inputs the determined second current I2 to the gate of the current mirror circuit, and controls the gate voltage of the NMOS transistor 116 in response to an image signal V16. Thus, it is possible to control the gate voltage potential of the current mirror circuit. Also, it is possible to modulate the driving current of the laser diode 101.

In this circuit constitution, as well as the circuit illustrated in FIG. 9, the element which is connected in series to the laser diode 101 between the power supply and the ground potential is set to only the NMOS transistor 115. Therefore, it is possible to acquire the stable amount of light at the power supply voltage 3V or so. It should be noted that the detail of this circuit configuration is disclosed in Japanese Patent Application Laid-Open No. H11-126935.

However, in the light emitting element driving circuit illustrated in FIG. 9, the switched current is supplied to the laser diode 101 through the current mirror circuit which is constituted by the NMOS transistor 111 and the NMOS transistor 112. For this reason, in a case where the driving current to be supplied to the light emitting element 101 is stopped, if the gate voltage of the current mirror circuit becomes lower than a threshold voltage of the NMOS transistor 111, the NMOS transistor 111 comes to be in a non-conductive state. Consequently, since the route along which electric charges flow from the gate of the current mirror circuit to the ground potential is unavailable, discharge from the gate terminal of the current mirror circuit is delayed. For this reason, since a rise time of the current to be supplied to the laser diode 101 depends on a just-before off time, it is impossible to accurately control high-speed switching driving.

On the other hand, in the light emitting element driving circuit illustrated in FIG. 10, in a case where the driving current to the laser diode 101 is stopped, the NMOS transistor 116 comes to be in a conductive state, whereby the second current I2 flows in the NMOS transistor 116. For this reason, the gate voltage of the NMOS transistor 115 is determined based on the on resistance of the NMOS transistor 116. At this time, if the gate voltage of the NMOS transistor 115 exceeds a threshold voltage, the current is supplied from the NMOS transistor 115 to the laser diode 101. In recent years, the threshold current of the laser diode has reduced up to several milliamperes (mA). Consequently, in case of off controlling the laser diode, it is necessary to lower the on resistance of the NMOS transistor 116 so that the laser diode 101 does not emit light. In particular, in a case where the threshold voltage of the NMOS transistor 115 is low, a leakage current between the source and the drain is large, and the second current I2 is large, then it is necessary to enlarge the size of the W/L of the NMOS transistor 116.

SUMMARY OF THE INVENTION

It is desirable in the present invention to provide a light emitting element driving circuit which can execute an accurate and high-speed operation even at a lower power supply voltage.

That is, the light emitting element driving circuit according to the present invention is characterized by comprising a driving current supply circuit, connected to a light emitting element in series between a first power supply and a second power supply, to supply a driving current to the light emitting element according to a voltage of a control terminal; a current determination circuit to determine and output the current according to an amount of output light of the light emitting element; a current/voltage conversion circuit to convert the current determined by the current determination circuit into a voltage and output the acquired voltage to the control terminal of the driving current supply circuit in a case where a control signal is in a first state, and to electrically shield its output voltage terminal from the control terminal of the driving current supply circuit in a case where the control signal is in a second state; and a reset circuit to connect the control terminal of the driving current supply circuit to the second power supply in the case where the control signal is in the second state.

According to the present invention, the light emitting element can be accurately driven at high speed even at the low voltage supply voltage. Moreover, in a case where a transistor is used for a reset circuit, since it is unnecessary to enlarge the size of gate width (W)/gate length (L) of the relevant transistor, cost reduction can be achieved.

Further features of the present invention will become apparent from the following description of the exemplary embodiments with reference to the attached drawings.

DESCRIPTION OF THE EMBODIMENTS

First Embodiment

Figure 1:
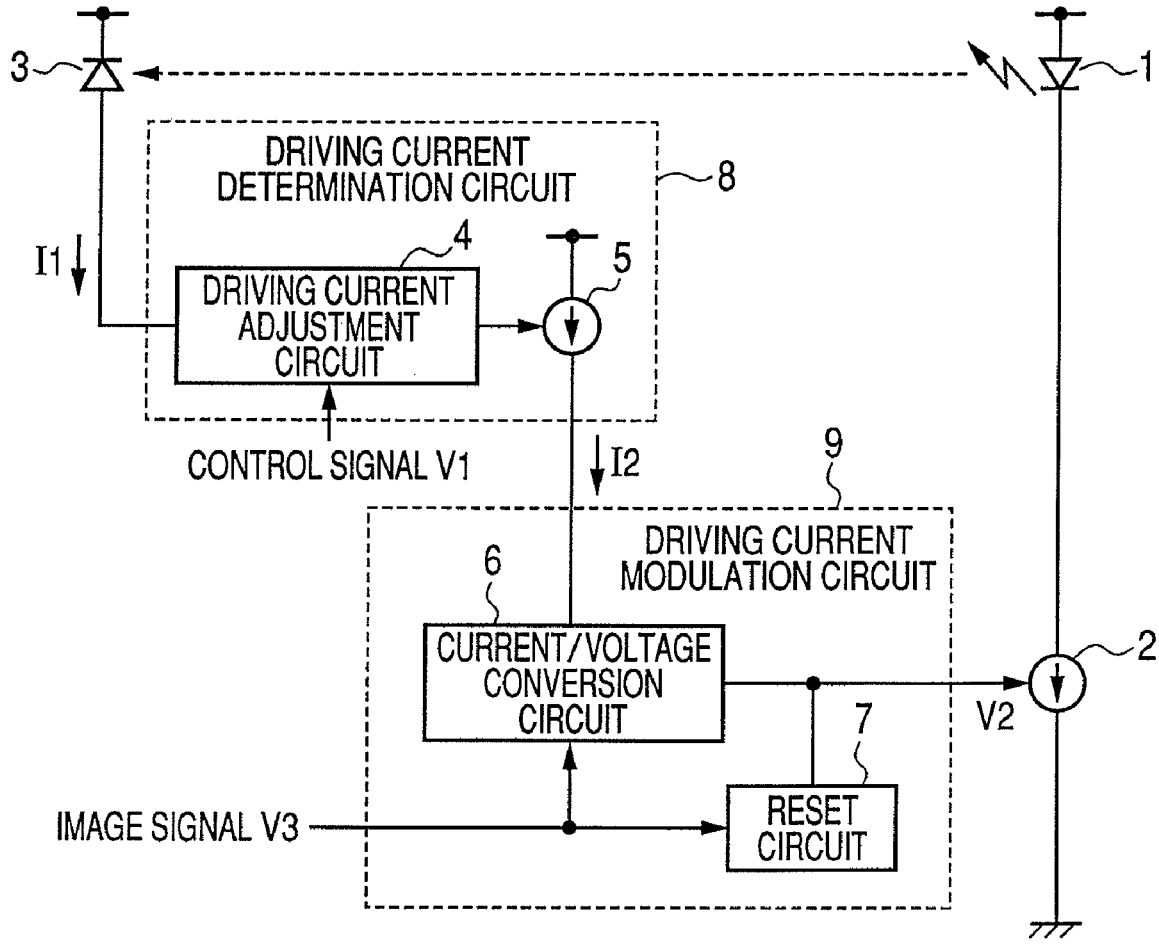
FIG. 1 is a block diagram illustrating an example of the constitution of a light emitting element driving circuit according to the first embodiment of the present invention.

FIG. 1 is a block diagram illustrating an example of the constitution of a light emitting element driving circuit according to the first embodiment of the present invention. The light emitting element driving circuit according to the first embodiment includes a laser diode 1 acting as a light emitting element, a first voltage controlled current source 2, a photodiode 3 acting as a light detecting element, a driving current adjustment circuit 4, a second voltage controlled current source 5, a current/voltage conversion circuit 6, and a reset circuit 7. Here, the driving current adjustment circuit 4 and the second voltage controlled current source 5 together constitute a driving current determination circuit 8, and the current/voltage conversion circuit 6 and the reset circuit 7 together constitute a driving current modulation circuit 9.

The anode of the laser diode 1 is connected to the power supply, the cathode of the laser diode 1 is connected to one end of the first voltage controlled current source 2, and the other end of the first voltage controlled current source 2 is connected to the ground potential, whereby a light emitting element driving current is supplied from the first voltage controlled current source 2 to the laser diode 1. An amount of light from the laser diode 1 is monitored by the photodiode 3, and the acquired light is subjected to photoelectrical conversion. Thus, the photodiode 3 outputs a first current I1 which is correlated with the amount of the output light of the laser diode 1. Then, the first current I1 is input to the driving current adjustment circuit 4 which partially constitutes the driving current determination circuit 8, and the output of the driving current adjustment circuit 4 controls the second voltage controlled current source 5 according to a control signal V1. Subsequently, a second current I2 which is correlated with the first current I1 is output from the voltage controlled current source 5, and the output second current I2 is then input to the driving current modulation circuit 9. The driving current modulation circuit 9 executes current/voltage conversion to the input second current I2 according to an image signal V3 to generate a voltage signal V2. Subsequently, the driving current modulation circuit 9 controls the first voltage controlled current source 2 according to the voltage signal V2, thereby modulating the driving current of the laser diode 1.

The driving current modulation circuit 9 is constituted by the current/voltage conversion circuit 6 and the reset circuit 7. The second current I2 is input to the current/voltage conversion circuit 6, the reset circuit 7 is connected to the output end of the current/voltage conversion circuit 6, and the connection portion between the reset circuit 7 and the current/voltage conversion circuit 6 acts as the output end of the driving current modulation circuit 9. If the driving current is supplied to the laser diode 1, the current/voltage conversion circuit 6 converts the second current I2 into a voltage, and the reset circuit 7 shields the output end of the current/voltage conversion circuit 6 from the ground potential. The driving current modulation circuit 9 outputs, as the voltage signal V2, the voltage subjected to the current/voltage conversion by the current/voltage conversion circuit 6, thereby controlling the first voltage controlled current source 2. If the driving current to be supplied to the laser diode 1 is stopped, the current/voltage conversion circuit 6 does not execute the current/voltage conversion to the second current I2, and the reset circuit 7 short-circuits the output end of the current/voltage conversion circuit 6 to the ground potential. Then, the driving current modulation circuit 9 outputs, as the voltage signal V2, the voltage which is equivalent to the ground potential, thereby controlling the first voltage controlled current source 2.

Figure 2:
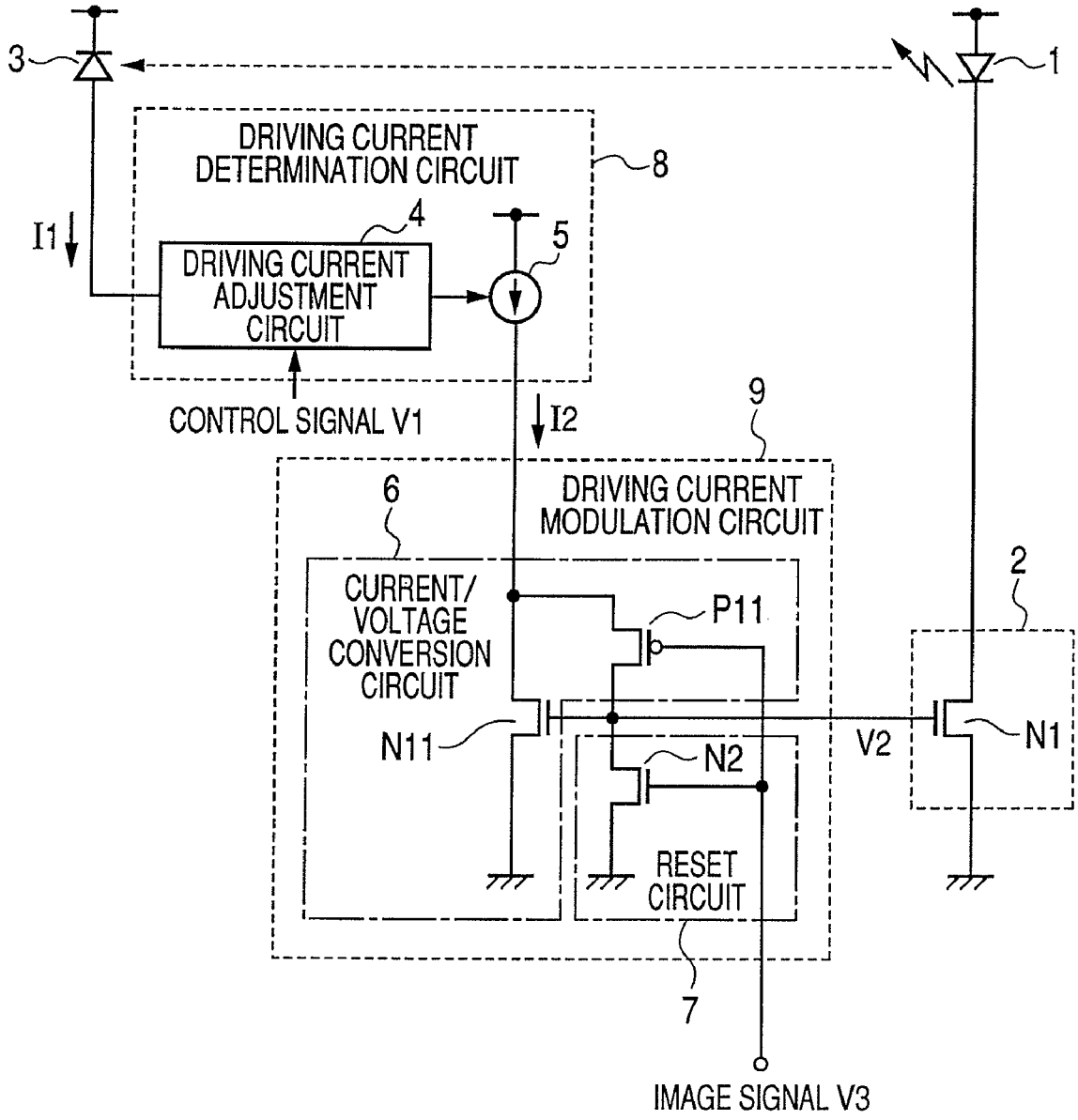
FIG. 2 is a block diagram illustrating an example of the constitution of the light emitting element driving circuit according to the first embodiment of the present invention.

FIG. 2 is a block diagram illustrating an example of the detailed constitution which includes the first voltage controlled current source 2, the current/voltage conversion circuit 6 and the reset circuit 7. It should be noted that an N-channel MOS field effect transistor is hereinafter called an NMOS transistor and a P-channel MOS field effect transistor is hereinafter called a PMOS transistor. The first voltage controlled current source 2 is constituted by an NMOS transistor N1, the current/voltage conversion circuit 6 is constituted by an NMOS transistor N11 and a PMOS transistor P11, and the reset circuit 7 is constituted by an NMOS transistor N2. Here, the drain of the NMOS transistor N11 is connected to the source of the PMOS transistor P11, and the connection portion between the NMOS transistor N11 and the PMOS transistor P11 acts as the input end of the current/voltage conversion circuit 6 through which the current I2 is input. The source of the NMOS transistor N11 is connected to the ground potential, the gate of the NMOS transistor N11 is connected to the drain of the PMOS transistor P11, and the connection portion between the NMOS transistor N11 and the PMOS transistor P11 acts as the output end of the current/voltage conversion circuit 6. Moreover, the drain of the NMOS transistor N2 which constitutes the reset circuit 7 is connected to the output end of the current/voltage conversion circuit 6, and the source of the NMOS transistor N2 is connected to the ground potential. In addition, the gate of the NMOS transistor N1 of which the source is connected to the ground potential is connected to the output end of the current/voltage conversion circuit 6, and the drain of the NMOS transistor N1 is connected to the cathode of the laser diode 1. Incidentally, the image signal V3 is input to the gate of the PMOS transistor P11 and the gate of the NMOS transistor N2.

Subsequently, the operation of the driving current modulation circuit 9 of which the constitution is different from that of the conventional light emitting element driving circuit will be described. If the driving current is supplied to the laser diode 1, the PMOS transistor P11 comes to be in a conductive state. The current/voltage conversion circuit 6 converts the input second current I2 into the voltage and then outputs the acquired voltage, and the NMOS transistor N2 which constitutes the reset circuit 7 comes to be in a non-conductive state. The driving current modulation circuit 9 outputs, as the voltage signal V2, the voltage subjected to the current/voltage conversion by the current/voltage conversion circuit 6, thereby controlling the gate voltage of the NMOS transistor N1. If the driving current to be supplied to the laser diode 1 is stopped, the PMOS transistor P11 comes to be in a non-conductive state. The current/voltage conversion circuit 6 does not execute the current/voltage conversion to the input second current I2, and the NMOS transistor N2 which constitutes the reset circuit 7 comes to be in a conductive state. Then, the driving current modulation circuit 9 outputs, as the voltage signal V2, the voltage equivalent to the ground potential, thereby controlling the gate voltage of the NMOS transistor N1. At this time, since the PMOS transistor P11 is in the non-conductive state, the second current I2 does not flow in the NMOS transistor N2. For this reason, since any potential difference does not occur between the source and the drain of the NMOS transistor N2, the gate potential of the NMOS transistor N1 is discharged through the NMOS transistor N2, whereby the gate potential of the NMOS transistor N1 comes to be equivalent to the ground potential. Consequently, it is unnecessary to enlarge the W/L size of the NMOS transistor N2. Also, it is possible to accurately control high-speed switching driving of the laser diode 1 as compared with the related art.

In FIG. 1, the light emitting element driving circuit according to the present embodiment includes the driving current supply circuit 2 (also called the voltage controlled current source 2), the driving current determination circuit 8, the current/voltage conversion circuit 6, and the reset circuit 7. The driving current supply circuit 2, which is connected in series to the light emitting element 1 between the first power supply and the second power supply, supplies the driving current to the light emitting element 1 according to the voltage of the control terminal. Here, it should be noted that the second power supply is, for example, the ground potential. The driving current determination circuit 8 determines and outputs the current according to the amount of the output light of the light emitting element 1. If the control signal V3 (also called the image signal V3) is in a first state, the current/voltage conversion circuit 6 converts the current determined by the driving current determination circuit 8 into the voltage and outputs the acquired voltage to the control terminal of the driving current supply circuit 2. Further, if the control signal V3 is in a second state, the current/voltage conversion circuit 6 electrically shields its output voltage terminal from the control terminal of the driving current supply circuit 2. Furthermore, if the control signal V3 is in the second state, the reset circuit 7 connects the control terminal of the driving current supply circuit 2 to the second power supply.

In FIG. 2, the current/voltage conversion circuit 6 includes the first field effect transistor N11 and a first switch P11 (also called the PMOS transistor P11). Here, the drain of the first field effect transistor N11 is connected to the output terminal of the driving current determination circuit 8, the source thereof is connected to the second power supply (for example, the ground potential), and the gate thereof is connected to the control terminal of the driving current supply circuit 2. It should be noted that the first switch P11 is, for example, the PMOS transistor. The first switch P11 is connected between the drain of the first field effect transistor N11 and the control terminal of the driving current supply circuit 2. Further, if the control signal (image signal) V3 is in the first state (low level), the first switch P11 comes to be in a conductive state. On the other hand, if the control signal V3 is in the second state (high level), the first switch P11 comes to be in a non-conductive state.

The reset circuit 7 includes a second switch N2 (also called the NMOS transistor N2). The second switch N2, which is, for example, the NMOS transistor, is connected between the control terminal of the driving current supply circuit 2 and the second power supply (for example, the ground potential). Further, if the control signal V3 is in the first state (low level), the second switch N2 comes to be in a non-conductive state. On the other hand, if the control signal V3 is in the second state (high level), the second switch N2 comes to be in a conductive state.

Second Embodiment

Figure 3:
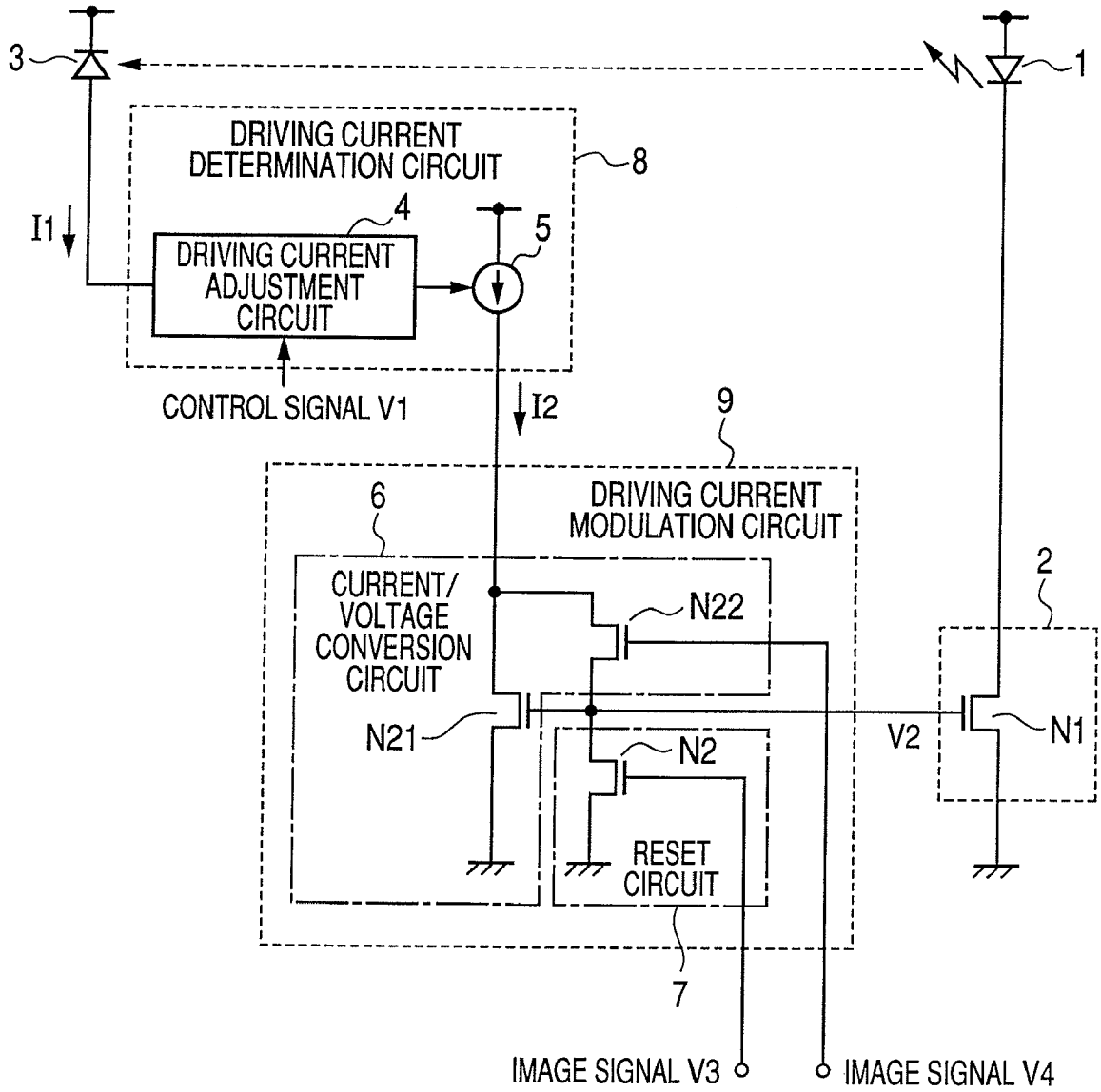
FIG. 3 is a block diagram illustrating an example of the constitution of a light emitting element driving circuit according to the second embodiment of the present invention.

FIG. 3 is a block diagram illustrating an example of the constitution of a light emitting element driving circuit according to the second embodiment of the present invention. Here, it should be noted that the second embodiment is different from the first embodiment only in the point of the circuit constitution of the current/voltage conversion circuit 6.

Hereinafter, the circuit constitution of the current/voltage conversion circuit 6 according to the second embodiment will be described. More specifically, the current/voltage conversion circuit 6 is constituted by an NMOS transistor N21 and an NMOS transistor N22. The drain of the NMOS transistor N21 is connected to the drain of the NMOS transistor N22, and the connection portion between the NMOS transistor N21 and the NMOS transistor N22 acts as the input end of the current/voltage conversion circuit 6 through which the current I2 is input. The source of the NMOS transistor N21 is connected to the ground potential, and the gate of the NMOS transistor N21 is connected to the source of the NMOS transistor N22, and the connection portion between the NMOS transistor N21 and the NMOS transistor N22 acts as the output end of the current/voltage conversion circuit 6. The source of the NMOS transistor N22 is connected to the gate of the NMOS transistor N21. Further, an image signal V4, which is in inversion relation to the image signal V3 input to the gate of the NMOS transistor N2 constituting the reset circuit 7, is input to the gate of the NMOS transistor N22.

As well as the first embodiment, in the second embodiment, the NMOS transistor N22 comes to be in a conductive state if the driving current is supplied to the laser diode 1. The current/voltage conversion circuit 6 converts the input second current I2 into the voltage and then outputs the acquired voltage, and the NMOS transistor N2 comes to be in a non-conductive state. The driving current modulation circuit 9 outputs, as the voltage signal V2, the voltage subjected to the current/voltage conversion by the current/voltage conversion circuit 6, thereby controlling the gate voltage of the NMOS transistor N1. If the driving current to be supplied to the laser diode 1 is stopped, the NMOS transistor N22 comes to be in a non-conductive state. The current/voltage conversion circuit 6 does not execute the current/voltage conversion to the input second current I2, and the NMOS transistor N2 comes to be in a conductive state. Then, the driving current modulation circuit 9 outputs, as the voltage signal V2, the voltage equivalent to the ground potential, thereby controlling the gate voltage of the NMOS transistor N1. Consequently, it is unnecessary to enlarge the W/L size of the NMOS transistor N2. Also, it is possible to accurately control high-speed switching driving of the laser diode 1 as compared with the related art.

In the first and second embodiments, if the driving current to the laser diode 1 is stopped, both the NMOS transistors N21 and N22 come to be in the non-conductive state, the route along which the input second current I2 flows is unavailable, whereby the drain voltage of the NMOS transistor N21 increases. For this reason, in case of starting the driving current to the laser diode 1, the drain voltage of the NMOS transistor N21 becomes unstable, whereby there is a case where supply of the driving current to the laser diode 1 becomes unstable.

Third Embodiment

Figure 4:
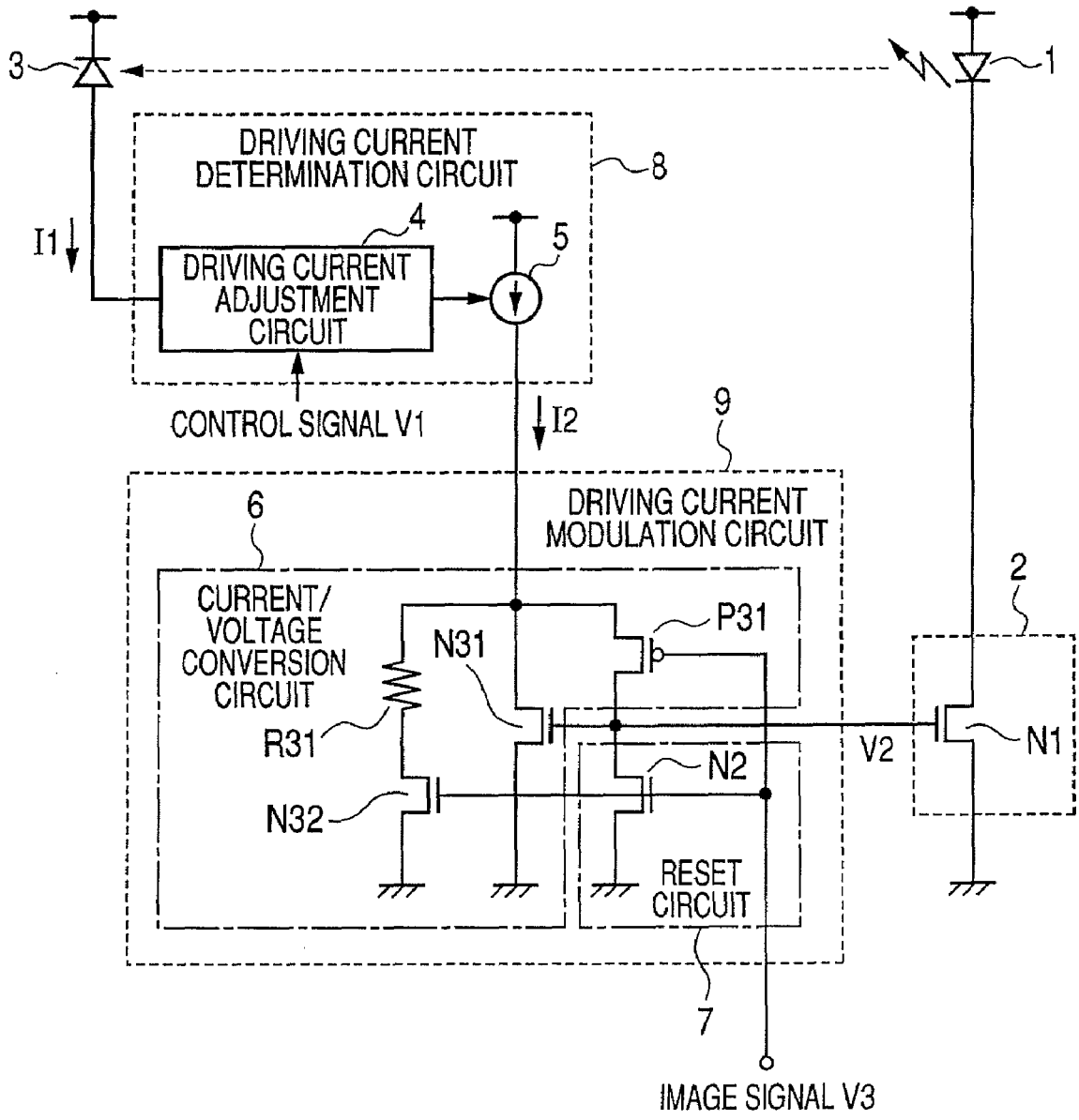
FIG. 4 is a block diagram illustrating an example of the constitution of a light emitting element driving circuit according to the third embodiment of the present invention.

FIG. 4 is a block diagram illustrating an example of the constitution of a light emitting element driving circuit according to the third embodiment of the present invention. Here, it should be noted that the third embodiment is different from the first embodiment in the point that a resistor R31 and an NMOS transistor N32 are added to the current/voltage conversion circuit 6. According to the third embodiment, it is possible to more accurately control high-speed switching driving as compared with the first embodiment.

An NMOS transistor N31 and a PMOS transistor P31 are connected respectively as well as the NMOS transistor N11 and the PMOS transistor P11 in the first embodiment. One end of the resistor R31 is connected to the drain of the NMOS transistor N31, and the other end of the resistor R31 is connected to the drain of the NMOS transistor N32. The source of the NMOS transistor N32 is connected to the ground potential, and the image signal V3 to be input to the gate of the NMOS transistor N2 is also input to the gate of the NMOS transistor N32. Further, the resistance of the resistor R31 is set so that the combined resistance of the on resistance of the NMOS transistor N32 and the resistance of the resistor R31 is equivalent to the on resistance of the NMOS transistor N31.

In case of supplying the driving current to the laser diode 1 in the third embodiment, the operation same as that in the first embodiment is executed. That is, if the driving current to be supplied to the laser diode 1 is stopped, the PMOS transistor P31 comes to be in a non-conductive state, the NMOS transistor N32 comes to be in a conductive state, and the second current I2 flows in the resistor R31 and the NMOS transistor N32. It is set in the third embodiment so that, at this time, the combined resistance of the on resistance of the NMOS transistor N32 and the resistance of the resistor R31 is equivalent to the on resistance of the NMOS transistor N31. For this reason, the drain voltage of the NMOS transistor N31 is kept the same voltage as the drain voltage of the NMOS transistor N31 at the time when the driving current is supplied to the laser diode 1. Consequently, it is possible to accurately control high-speed switching driving as compared with the first embodiment.

Likewise, since the resistor R31 and the NMOS transistor N32 are added, it is possible to more accurately control high-speed switching driving of the laser diode 1 as compared with the second embodiment.

In the present embodiment, the resistor R31 and the switch (NMOS transistor) N32 are added to the constitution described in the first embodiment (FIG. 2). The current/voltage conversion circuit 6 further includes the resistor R31 and the switch N32 which are connected in series between the drain of the first field effect transistor N31 and the second power supply (for example, the ground potential). Here, the switch N32 is, for example, the NMOS transistor. If the control signal (image signal) V3 is in the first state (low level), the switch N32 comes to be in a non-conductive state. On the other hand, if the control signal V3 is in the second state (high level), the switch N32 comes to be in a conductive state.

Fourth Embodiment

Figure 5:
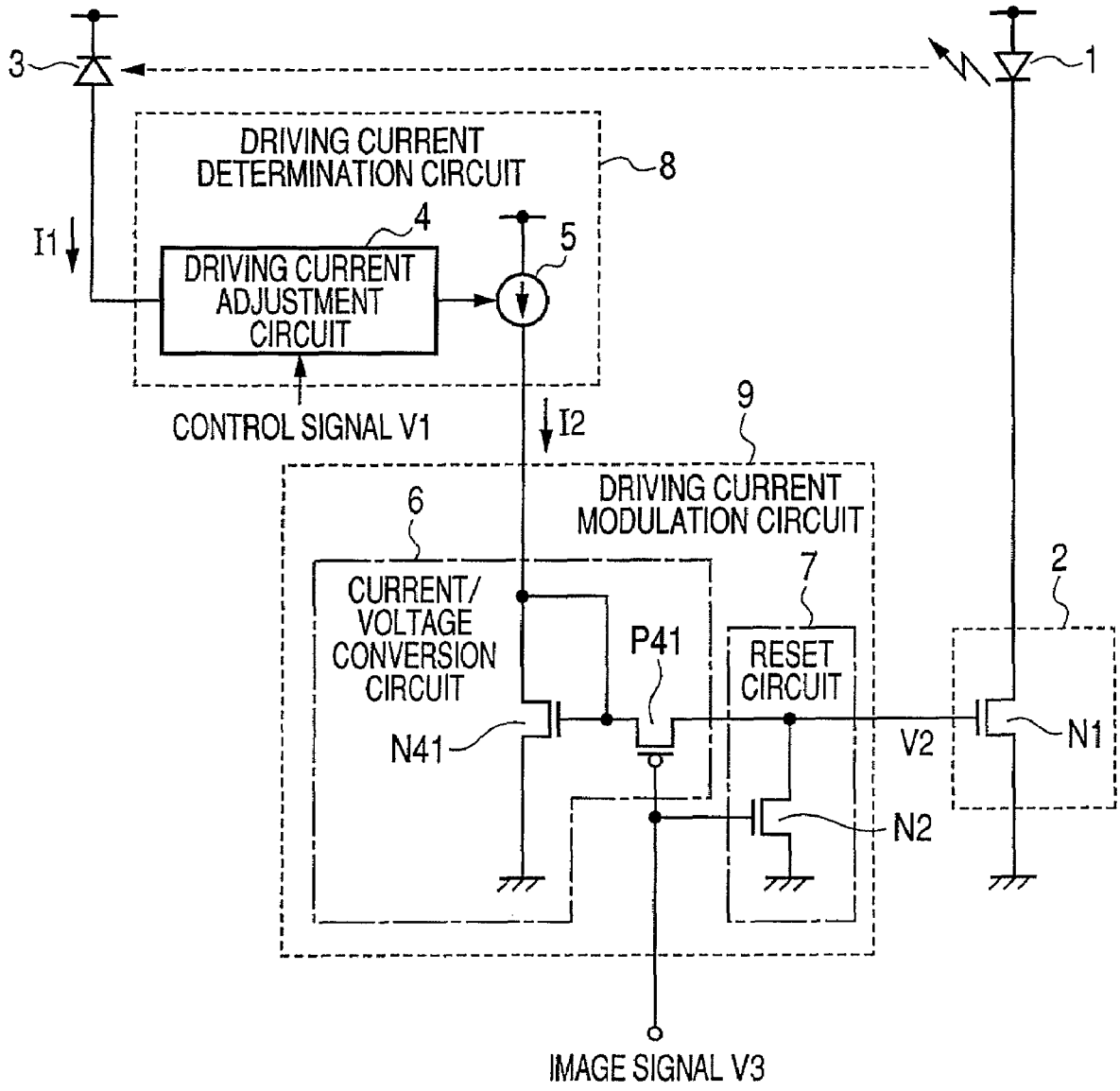
FIG. 5 is a block diagram illustrating an example of the constitution of a light emitting element driving circuit according to the fourth embodiment of the present invention.

FIG. 5 is a block diagram illustrating an example of the constitution of a light emitting element driving circuit according to the fourth embodiment of the present invention. Here, it should be noted that the fourth embodiment is different from the first embodiment only in the point of the circuit constitution of the current/voltage conversion circuit 6.

The current/voltage conversion circuit 6 is constituted by an NMOS transistor N41 and a PMOS transistor P41. The source of the NMOS transistor N41 is connected to the ground potential, and the drain of the NMOS transistor N41 is connected to the gate of the NMOS transistor N41 and the source of the PMOS transistor P41. The connection portion between the NMOS transistor N41 and the PMOS transistor P41 acts as the input end of the current/voltage conversion circuit 6 through which the input current I2 is input. On the other hand, the drain of the PMOS transistor P41 acts as the output end of the current/voltage conversion circuit 6. The image signal V3, which is input to the gate of the NMOS transistor N2 constituting the reset circuit 7, is input to the gate of the PMOS transistor P41.

In case of supplying the driving current to the laser diode 1, the PMOS transistor P41 comes to be in a conductive state. The current/voltage conversion circuit 6 converts the input current I2 into the voltage and outputs the acquired voltage, and the NMOS transistor N2 comes to be in a non-conductive state. The driving current modulation circuit 9 outputs, as the voltage signal V2, the voltage subjected to the current/voltage conversion by the current/voltage conversion circuit 6.

In case of stopping the driving current to the laser diode 1, the PMOS transistor P41 comes to be in a non-conductive state. The current/voltage conversion circuit 6 does not convert the input current I2 into the voltage, and the NMOS transistor N2 comes to be in a conductive state. The driving current modulation circuit 9 outputs, as the voltage signal V2, the voltage equivalent to the ground potential, thereby controlling the gate voltage of the NMOS transistor N1. At this time, the second current I2 flows to the ground potential through the NMOS transistor N41.

Consequently, as well as the third embodiment, the drain voltage of the NMOS transistor N41 at the time of supplying the driving current to the laser diode 1 is the same as that at the time of stopping the driving current to the laser diode 1. For this reason, it is unnecessary to enlarge the W/L size of the NMOS transistor N2. Also, it is possible to accurately control high-speed switching driving of the laser diode 1.

The current/voltage conversion circuit 6 includes the first field effect transistor N41 and a first switch (PMOS transistor) P41. The drain of the first field effect transistor N41 is connected to the output terminal of the driving current determination circuit 8, the source thereof is connected to the second power supply (for example, the ground potential), and the gate thereof is connected to the drain of the first field effect transistor N41 itself. Here, the first switch P41 is, for example, the PMOS transistor, and the first switch P41 is connected between the drain of the first field effect transistor N41 and the control terminal of the driving current supply circuit 2. Moreover, if the control signal (image signal) V3 is in the first state (low level), the first switch P41 comes to be in a conductive state. On the other hand, if the control signal V3 is in the second state (high level), the first switch P41 comes to be in a non-conductive state.

The reset circuit 7 includes a second switch (NMOS transistor) N2. The second switch N2 is, for example, the NMOS transistor, and the second switch N2 is connected between the control terminal of the driving current supply circuit 2 and the second power supply (for example, the ground potential). Moreover, if the control signal V3 is in the first state (low level), the second switch N2 comes to be in a non-conductive state. On the other hand, if the control signal V3 is in the second state (high level), the second switch N2 comes to be in a conductive state.

Fifth Embodiment

Figure 6:
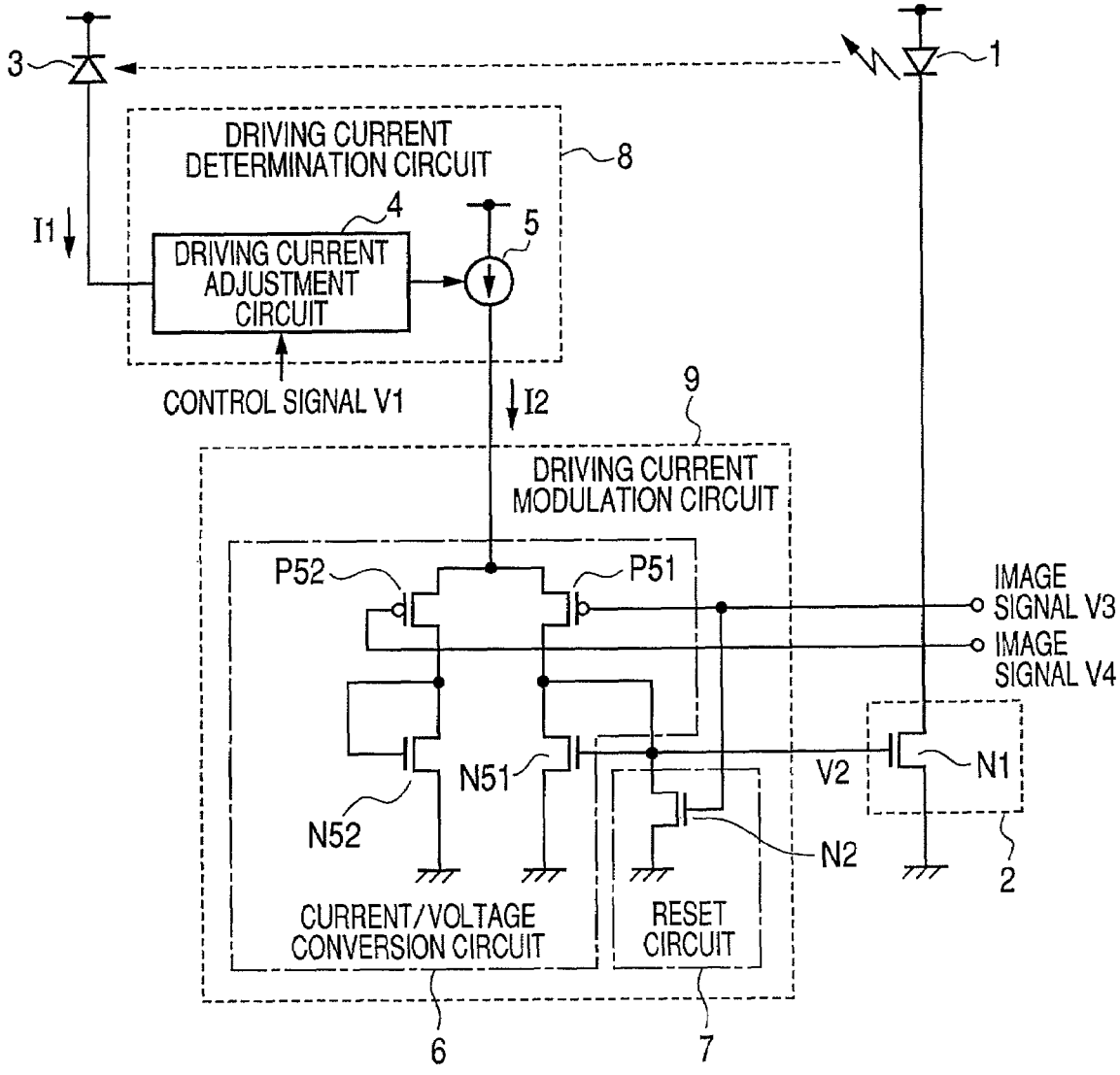
FIG. 6 is a block diagram illustrating an example of the constitution of a light emitting element driving circuit according to the fifth embodiment of the present invention.
Figure 7:
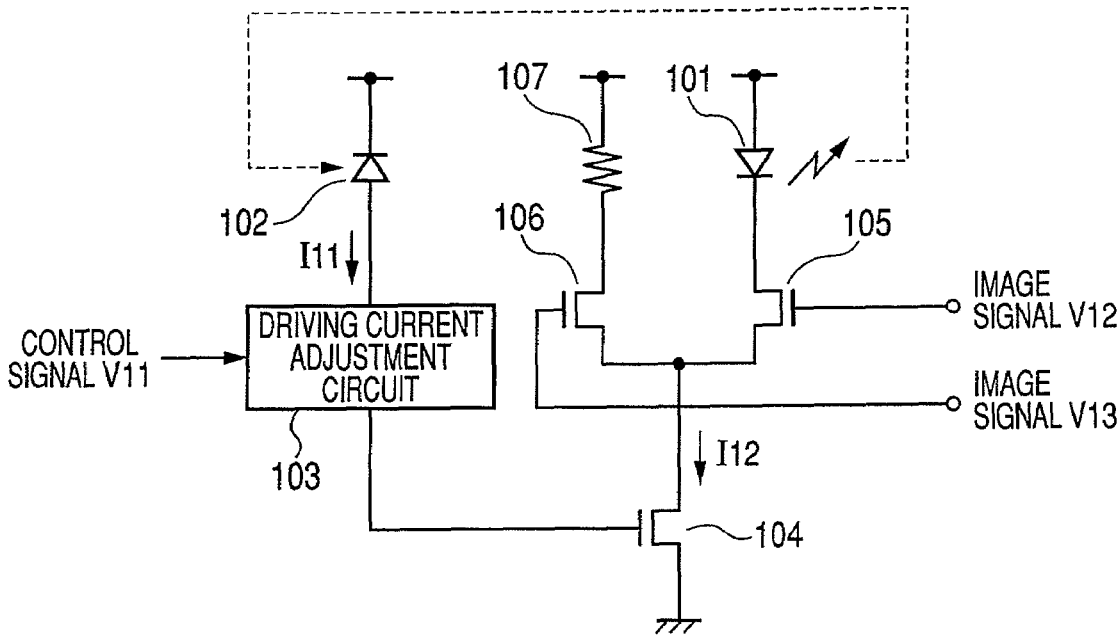
FIG. 7 is a block diagram illustrating an example of the constitution of a conventional light emitting element driving circuit.
Figure 8:
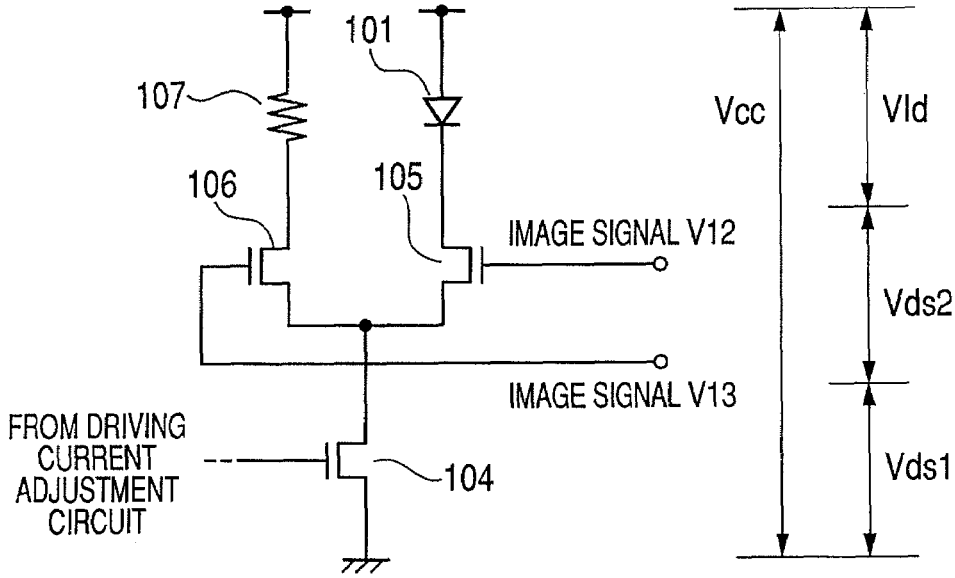
FIG. 8 is a diagram for describing the voltages of the conventional light emitting element driving circuit.
Figure 9:
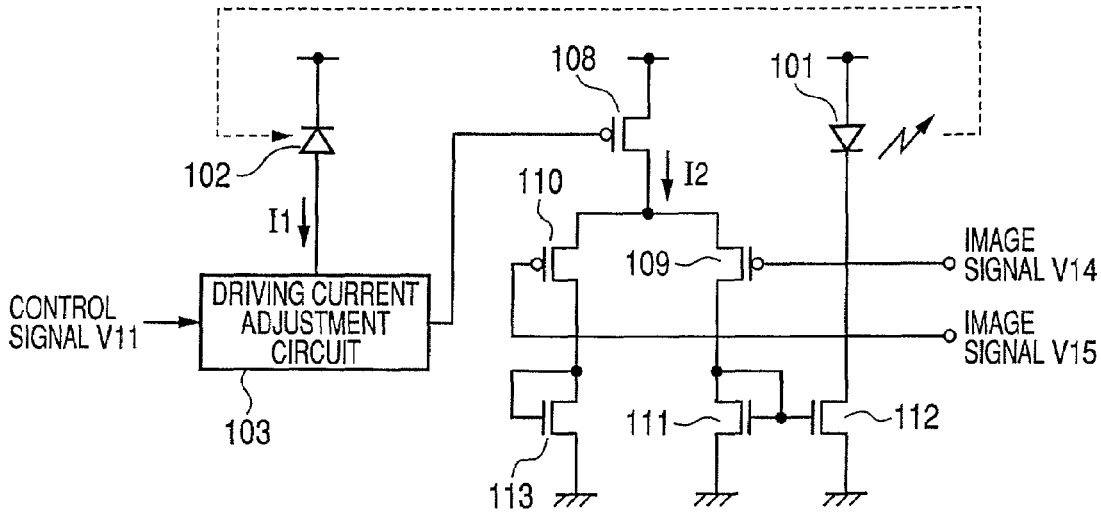
FIG. 9 is a block diagram illustrating an example of the constitution of a conventional light emitting element driving circuit.
Figure 10:
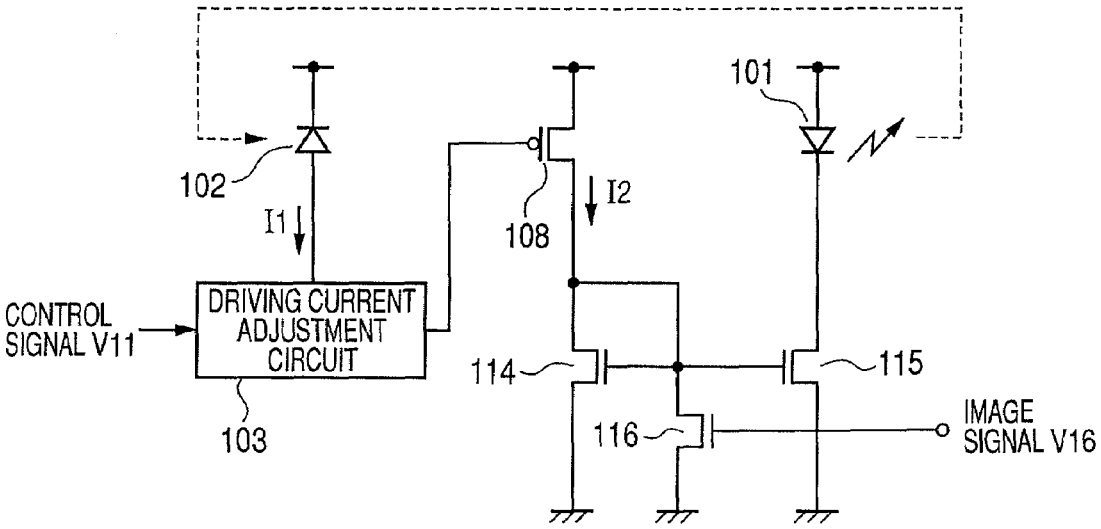
FIG. 10 is a block diagram illustrating an example of the constitution of a conventional light emitting element driving circuit.

FIG. 6 is a block diagram illustrating an example of the constitution of a light emitting element driving circuit according to the fifth embodiment of the present invention. Here, it should be noted that the fifth embodiment is different from the first embodiment only in the point of the circuit constitution of the current/voltage conversion circuit 6.

The current/voltage conversion circuit 6 is constituted by an NMOS transistor N51, an NMOS transistor N52, a PMOS transistor P51 and a PMOS transistor P52. The source of the PMOS transistor P51 and the source of the PMOS transistor P52 are connected to each other, and the connection portion between the PMOS transistor P51 and the PMOS transistor P52 acts as the input end of the current/voltage conversion circuit 6 through which the second current I2 is input. The image signal V3, which is input to the gate of the NMOS transistor N2 constituting the reset circuit 7, is also input to the gate of the PMOS transistor P51. Further, the image signal V4, which is in inversion relation to the image signal V3, is input to the gate of the PMOS transistor P52. The PMOS transistor P51 and the PMOS transistor P52 together constitute the differential switch circuit which is controlled in response to the image signals V3 and V4. The drain of the PMOS transistor P51 is connected to the drain and the gate of the NMOS transistor N51 of which the source is connected to the ground potential, and the connection portion between the PMOS transistor P51 and the NMOS transistor N51 acts as the output end of the current/voltage conversion circuit 6. Further, the drain of the PMOS transistor P52 is connected to the drain and the gate of the NMOS transistor N52 of which the source is connected to the ground potential.

In case of supplying the driving current to the laser diode 1, the second current I2 flows in the PMOS transistor P51. Thus, the current/voltage conversion circuit 6 converts the second current I2 input to the NMOS transistor N51 into the voltage and outputs the acquired voltage, whereby the NMOS transistor N2 comes to be in a non-conductive state. Then, the driving current modulation circuit 9 outputs, as the voltage signal V2, the voltage subjected to the current/voltage conversion by the current/voltage conversion circuit 6.

In case of stopping the driving current to the laser diode 1, the second current I2, which is input to the current/voltage conversion circuit 6, flows in the PMOS transistor P52. The current/voltage conversion circuit 6 does not convert the input second current I2 into the voltage, and the NMOS transistor N2 comes to be in a conductive state. The second current I2 is not converted into the voltage, and the driving current modulation circuit 9 outputs, as the voltage signal V2, the voltage equivalent to the ground potential.

For this reason, as well as the first embodiment, in case of stopping the driving current to the laser diode 1, the second current I2 does not flow in the NMOS transistor N2 which constitutes the reset circuit 7. Consequently, it is unnecessary to enlarge the W/L size of the NMOS transistor N2. Also, it is possible to accurately control high-speed switching driving of the laser diode 1.

The current/voltage conversion circuit 6 includes the first field effect transistor N52, a first switch (PMOS transistor)

P52, the second field effect transistor N51, and a second switch (PMOS transistor) P51.

The drain of the first field effect transistor N52 is connected to the output terminal of the driving current determination circuit 8, the source thereof is connected to the second power supply (for example, the ground potential), and the gate thereof is connected to the own drain. The first switch P52, which is, for example, the PMOS transistor, is connected in series to the first field effect transistor N52 between the output terminal of the driving current determination circuit 8 and the second power supply (for example, the ground potential). Further, if the control signal (also called the image signal) V4 is in the first level (low level), the first switch P52 comes to be in a conductive state. On the other hand, if the control signal V4 is in the second level (high level), the first switch P52 comes to be in a non-conductive state.

The drain of the second field effect transistor N51 is connected to the output terminal of the driving current determination circuit 8, the source thereof is connected to the second power supply (for example, the ground potential), and the gate thereof is connected to the own drain and the control terminal of the driving current supply circuit 2. The second switch P51, which is, for example, the PMOS transistor, is connected in series to the second field effect transistor N51 between the output terminal of the driving current determination circuit 8 and the second power supply (for example, the ground potential). Further, if the control signal V3 is in the first level (low level), the second switch P51 comes to be in a conductive state. On the other hand, if the control signal V3 is in the second level (high level), the second switch P51 comes to be in a non-conductive state.

The reset circuit 7 includes a third switch (NMOS transistor) N2. The third switch N2, which is, for example, the NMOS transistor, is connected between the control terminal of the driving current supply circuit 2 and the second power supply (for example, the ground potential). Further, if the control signal V3 is in the first state (low level), the third switch N2 comes to be in a non-conductive state. On the other hand, if the control signal V3 is in the second state (high level), the third switch N2 comes to be in a conductive state.

In each of the first to fifth embodiments, the light emitting element driving circuit for driving the light emitting element 1 of which the anode is connected to the power supply is described. However, the present invention is not limited to this. That is, even in the light emitting element driving circuit for driving the light emitting element 1 of which the cathode is connected to the power supply, it is possible to acquire the same effect as described above by replacing the NMOS transistor with the PMOS transistor and also replacing the PMOS transistor with the NMOS transistor.

In the light emitting element driving circuit according to the embodiments of the present invention, one end of the light emitting element 1 is connected in series to one end of the driving current supply circuit 2 for supplying the driving current to the light emitting element 1, the other end of the light emitting element 1 is connected to the first power supply, and the other end of the driving current supply circuit 2 is connected to the second power supply. The light emitting element driving circuit includes the light detecting element 3 for outputting the first signal in proportion to the amount of output light of the light emitting element 1, the driving current determination circuit 8 for determining the driving current of the light emitting element 1 to be able to acquire the desired amount of output light from the first signal, and the driving current modulation circuit 9. The driving current modulation circuit 9 modulates the driving current in response to the image signal V3. The driving current supply circuit 2, which is the voltage controlled current source, is controlled in response to the output signal of the driving current modulation circuit 9. The output signal of the driving current determination circuit 8 is a current signal, and the driving current modulation circuit 9 is constituted by the current/voltage conversion circuit 6 and the reset circuit 7. In case of supplying the driving current to the light emitting element 1, the current/voltage conversion circuit 6 outputs the voltage signal acquired by converting the above current signal. Further, in case of stopping the driving current to the light emitting element 1, the current/voltage conversion circuit 6 does not convert the above current signal into the voltage signal, and the reset circuit 7 outputs the voltage equivalent to that of the second power supply.

According to the present invention, it is possible to accurately operate the light emitting element driving circuit of the image formation device at high speed even at the low voltage supply voltage of 3V or so. Also, it is unnecessary to enlarge the W/L size of the MOS transistor to be used for the reset circuit 7 in the driving current modulation circuit 9, whereby it is possible to effectively achieve cost reduction.

While the present invention has been described with reference to the exemplary embodiments, it is to be understood that the present invention is not limited to the disclosed embodiments. The scope of the following claims is to be accorded the broadest interpretation so as to encompass all such modifications and equivalent structures and functions.

This application claims the benefit of Japanese Patent Application No. 2007-092134, filed Mar. 30, 2007, which is hereby incorporated by reference herein in its entirety.

What is claimed is:

1. A light emitting element driving circuit comprising:

a driving current supply circuit, connected to a light emitting element in series between a first power supply and a second power supply, adapted to supply a driving current to the light emitting element according to a voltage of a control terminal;

a driving current determination circuit adapted to determine and output the current according to an amount of output light of the light emitting element;

a current/voltage conversion circuit adapted to convert the current determined by the driving current determination circuit into a voltage and output the converted voltage to the control terminal of the driving current supply circuit in a case where a control signal is in a first state, and to electrically shield its output voltage terminal from the control terminal of the driving current supply circuit in a case where the control signal is in a second state; and a reset circuit adapted to connect the control terminal of the driving current supply circuit to the second power supply in the case where the control signal is in the second state, wherein the current/voltage conversion circuit includes a first field effect transistor of which a drain is connected to an output terminal of the driving current determination circuit, a source is connected to the second power supply, and a gate is connected to a control terminal of the driving current supply circuit, and a first switch which is connected between the drain of the first field effect transistor and the control terminal of the driving current supply circuit, comes to be in a conductive state in the case where the control signal is in the first state, and comes to be in a non-conductive state in the case where the control signal is in the second state, and wherein the reset circuit includes a second switch which is connected between the control terminal of the driving current supply circuit and the second power supply, comes to be in a non-conductive state in the case where the control signal is in the first state, and comes to be in a conductive state in the case where the control signal is in the second state.

2. A light emitting element driving circuit according to claim 1, wherein each of the first and second switches is a field effect transistor.

3. A light emitting element driving circuit according to claim 1, wherein the current/voltage conversion circuit further includes a resistor and a third switch which are connected in series between the drain of the first field effect transistor and the second power supply, and the third switch comes to be in a non-conductive state in the case where the control signal is in the first state, and comes to be in a conductive state in the case where the control signal is in the second state.

4. A light emitting element driving circuit according to claim 3, wherein each of the first, second and third switches is a field effect transistor.

5. A light emitting element driving circuit comprising:

a driving current supply circuit, connected to a light emitting element in series between a first power supply and a second power supply, adapted to supply a driving current to the light emitting element according to a voltage of a control terminal;

a driving current determination circuit adapted to determine and output the current according to an amount of output light of the light emitting element;

a current/voltage conversion circuit adapted to convert the current determined by the driving current determination circuit into a voltage and output the converted voltage to the control terminal of the driving current supply circuit in a case where a control signal is in a first state, and to electrically shield its output voltage terminal from the control terminal of the driving current supply circuit in a case where the control signal is in a second state; and a reset circuit adapted to connect the control terminal of the driving current supply circuit to the second power supply in the case where the control signal is in the second state, wherein the current/voltage conversion circuit includes a first field effect transistor of which a drain is connected to an output terminal of the driving current determination circuit, a source is connected to the second power supply, and a gate is connected to an own drain, and a first switch which is connected between the drain of the first field effect transistor and the control terminal of the driving current supply circuit, comes to be in a conductive state in the case where the control signal is in the first state, and comes to be in a non-conductive state in the case where the control signal is in the second state, and wherein the reset circuit includes a second switch which is connected between the control terminal of the driving current supply circuit and the second power supply, comes to be in a non-conductive state in the case where the control signal is in the first state, and comes to be in a conductive state in the case where the control signal is in the second state.

6. A light emitting element driving circuit according to claim 5, wherein each of the first and second switches is a field effect transistor.

7. A light emitting element driving circuit comprising:

a driving current supply circuit, connected to a light emitting element in series between a first power supply and a second power supply, adapted to supply a driving current to the light emitting element according to a voltage of a control terminal;

a driving current determination circuit adapted to determine and output the current according to an amount of output light of the light emitting element;

a current/voltage conversion circuit adapted to convert the current determined by the driving current determination circuit into a voltage and output the converted voltage to the control terminal of the driving current supply circuit in a case where a control signal is in a first state, and to electrically shield its output voltage terminal from the control terminal of the driving current supply circuit in a case where the control signal is in a second state; and a reset circuit adapted to connect the control terminal of the driving current supply circuit to the second power supply in the case where the control signal is in the second state, wherein the current/voltage conversion circuit includes a first field effect transistor of which a drain is connected to an output terminal of the driving current determination circuit, a source is connected to the second power supply, and a gate is connected to an own drain, a first switch which is connected in series with the first field effect transistor between the output terminal of the driving current determination circuit and the second power supply, comes to be in a non-conductive state in the case where the control signal is in the first state, and comes to be in a conductive state in the case where the control signal is in the second state, a second field effect transistor of which a drain is connected to the output terminal of the driving current determination circuit, a source is connected to the second power supply, and a gate is connected to an own drain and the control terminal of the driving current supply circuit, and a second switch which is connected in series with the second field effect transistor between the output terminal of the driving current determination circuit and the second power supply, comes to be in a conductive state in the case where the control signal is in the first state, and comes to be in a non-conductive state in the case where the control signal is in the second state, and wherein the reset circuit includes a third switch which is connected between the control terminal of the driving current supply circuit and the second power supply, comes to be in a non-conductive state in the case where the control signal is in the first state, and comes to be in a conductive state in the case where the control signal is in the second state.

8. A light emitting element driving circuit according to claim 7, wherein each of the first, second and third switches is a field effect transistor.

* * * * *